US006232829B1

(12) United States Patent
Dow

(10) Patent No.: US 6,232,829 B1
(45) Date of Patent: May 15, 2001

(54) BANDGAP VOLTAGE REFERENCE CIRCUIT WITH AN INCREASED DIFFERENCE VOLTAGE

(75) Inventor: Ronald N. Dow, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/442,953

(22) Filed: Nov. 18, 1999

(51) Int. Cl.[7] ..... G05F 1/10
(52) U.S. Cl. ..... 327/539; 327/513; 323/315
(58) Field of Search ..... 327/538, 539, 327/540, 512, 513; 323/312, 313, 315

(56) References Cited

U.S. PATENT DOCUMENTS

| | | | | |
|---|---|---|---|---|
| 3,617,859 | | 11/1971 | Dobkin | 323/4 |
| 3,796,943 | | 3/1974 | Nelson et al. | 323/9 |
| 3,887,863 | | 6/1975 | Browkaw | 323/19 |
| 3,930,172 | | 12/1975 | Dobkin | 307/297 |
| 5,347,174 | * | 9/1994 | Gotz | 323/315 |
| 5,604,427 | | 2/1997 | Kimura | 323/313 |
| 5,654,665 | | 8/1997 | Menon et al. | 327/541 |
| 5,828,329 | * | 10/1998 | Burns | 323/315 |
| 5,852,376 | * | 12/1998 | Kraus | 327/539 |
| 5,955,874 | * | 9/1999 | Zhou et al. | 323/315 |

OTHER PUBLICATIONS

"Physics and Technology of Semiconductor Devices" A.S. Grove, p. 220. Publishers: John Wiley & Sons, 1967.
National Semiconductor Application Note 56, Dec. 1971; National Semiconductor Corporation, TL/H/7370, pp. 1–4, 1.2V Reference.

* cited by examiner

*Primary Examiner*—Jung Ho Kim
(74) *Attorney, Agent, or Firm*—Pillsbury Winthrop LLP

(57) ABSTRACT

A reference voltage output by a bandgap voltage reference circuit is formed by summing an amplified voltage that has a positive temperature coefficient with a base-to-emitter voltage that has a negative temperature coefficient. The amplified voltage is formed by amplifying a difference voltage $\Delta V_{BE}$. Variations over temperature of the reference voltage are reduced by increasing the magnitude of the difference voltage $\Delta V_{BE}$. By increasing the magnitude of the difference voltage $\Delta V_{BE}$, a smaller gain can be used to form the amplified voltage. By utilizing a smaller gain, less of the error associated with the difference voltage $\Delta V_{BE}$ is present in the amplified voltage.

21 Claims, 9 Drawing Sheets

BANDGAP VOLTAGE REFERENCE CIRCUIT WITH AN INCREASED DIFFERENCE VOLTAGE

BACKGROUND OF THE INVENTION

1. Field of the Invention

The present invention relates to a bandgap voltage reference circuit and, more particularly, to a bandgap voltage reference circuit with an increased difference voltage $\Delta V_{BE}$.

2. Description of the Related Art

A bandgap voltage reference circuit is a circuit that provides a reference voltage that is ideally temperature independent. Bandgap voltage reference circuits are commonly used as stand-alone voltage sources, and as building blocks in analog-to-digital converters, digital-to-analog converters, bias line generators, and other common analog circuits.

FIG. 1 shows a schematic diagram that illustrates a conventional bandgap voltage reference circuit 100. As shown in FIG. 1, circuit 100 includes a current source 110 that outputs a current I that is proportional to absolute temperature (PTAT), and transistors Q1, Q2, and Q3. The collectors of transistors Q1 and Q2 are connected to current source 110 through resistors R1 and R2, respectively, while the collector of transistor Q3 is directly connected to current source 110.

In addition, the emitters of transistors Q1 and Q3 are connected together, while the emitter of transistor Q2, which has an emitter area that is N times larger than the emitter area of transistor Q1, is connected to the emitter of transistor Q1 through resistor R3. Further, the bases of transistors Q1 and Q2 are connected to the collector of transistor Q1, while the base of transistor Q3 is connected to the collector of transistor Q2.

In operation, circuit 100 provides a nearly temperature independent reference voltage $V_{REF}$ between the collector and emitter of transistor Q3 by summing a voltage that has a positive temperature coefficient with voltage that has a negative temperature coefficient of equal value.

For example, when the temperature increases by one degree, the voltage with the positive temperature coefficient increases by, for example, 2 mV while the voltage with the negative temperature coefficient decreases by 2 mV. Since the voltages vary an equal amount in opposite directions, the reference voltage $V_{REF}$ remains unchanged when the temperature increases by one degree.

With respect to the voltage with the positive temperature coefficient, it is known that the difference between the base-to-emitter voltages of a pair of bipolar transistors that are forced to operate with unequal emitter current densities is a voltage with a positive temperature coefficient.

In circuit 100, since transistor Q2 has an emitter area that is N times larger than the emitter area of transistor Q1, transistors Q1 and Q2 operate with unequal emitter current densities. As a result, a difference voltage $\Delta V_{BE}$, which is equal to $V_{BEQ1}-V_{BEQ2}$, has a positive temperature coefficient.

As shown in FIG. 1, the base-to-emitter voltage $V_{BEQ1}$ of transistor Q1 is equal to the base-to-emitter voltage $V_{BEQ2}$ of transistor Q2 and the voltage VR3 across resistor R3, i.e., $V_{BEQ1}=V_{BEQ2}+VR3$. Rearranging yields $V_{BEQ1}-V_{BEQ2}=VR3$.

Since the difference voltage $\Delta V_{BE}$ is equal to the difference between the base-to-emitter voltages ($\Delta V_{BE}=V_{BEQ1}-V_{BEQ2}$), the difference voltage $\Delta V_{BE}$ is also equal to the voltage VR3 across resistor R3. Since the difference voltage $\Delta V_{BE}$ has a positive temperature coefficient, the voltage VR3 across resistor R3 must also have a positive temperature coefficient.

The voltage VR3 across resistor R3 (and the value of resistor R3) define the resistor current which, in turn, defines the emitter current $I_{EQ2}$ of transistor Q2. As a result, the emitter current $I_{EQ2}$ is proportional to the difference voltage $\Delta V_{BE}$ and, therefore, must have a positive temperature coefficient.

In addition, the collector current $I_{CQ2}$ of transistor Q2 is approximately equal to the emitter current $I_{EQ2}$ of transistor Q2 due to the beta of transistor Q2. As a result, the collector current $I_{CQ2}$ of transistor Q2 is proportional to the difference voltage $\Delta V_{BE}$ and, therefore, must have a positive temperature coefficient.

Thus, since the collector current $I_{CQ2}$ is proportional to the difference voltage $\Delta V_{BE}$, the voltage VR2 across resistor R2 is proportional to the difference voltage $\Delta V_{BE}$, and therefore must also have a positive temperature coefficient.

The voltage VR2 is also known as an amplified difference voltage $\Delta V_{BE}$ because the voltage VR2 is approximately equal to R2/R3 times the voltage VR3 which, in turn, is equal to the difference voltage $\Delta V_{BE}$.

With respect to the voltage with the negative temperature coefficient, it is known that the base-to-emitter voltage of a bipolar transistor has a negative temperature coefficient when the collector current of the transistor is proportional to absolute temperature.

As noted above, current source 110 outputs a current I that is proportional to absolute temperature. As a result, the base-to-emitter voltage $V_{BEQ3}$ of transistor Q3 has a negative temperature coefficient.

Thus, circuit 100 provides a nearly temperature independent reference voltage $V_{REF}$ between the collector and emitter of transistor Q3 by summing the voltage VR2, the amplified difference voltage $\Delta AV_{BE}$, with the base-to-emitter voltage $V_{BEQ3}$ across the base-to-emitter junction of transistor Q3.

The amplified difference voltage $\Delta AV_{BE}$ (VR2) has a positive temperature coefficient of approximately +2 mV/° C., while the base-to-emitter voltage $V_{BEQ3}$ has a negative temperature coefficient of approximately −2 mV/° C. Thus, by summing voltages which have equal and opposite temperature coefficients, the total voltage, i.e., the reference voltage $V_{REF}$, remains unchanged as the temperature changes. (See also U.S. Pat. No. 3,617,859 to Dobkin which is hereby incorporated by reference.)

FIG. 2 shows a schematic diagram that illustrates a conventional bandgap voltage reference circuit 200. Circuit 200 is similar to circuit 100 and, as a result, utilizes the reference numerals to designate the structures which are common to both circuits.

As shown in FIG. 2, circuit 200 differs from circuit 100 in that circuit 200 eliminates both current source 110 and transistor Q3, and instead utilizes an operational amplifier (op amp) 210 and a resistor R4. As with circuit 100, transistor Q2 of circuit 200 has an emitter area that is N times larger than the emitter area of transistor Q1 of circuit 200.

Op amp 210 has a positive input connected to the collector of transistor Q1, a negative input connected to the collector of transistor Q2, and an output connected to the bases of transistors Q1 and Q2. Resistor R4, in turn, has a first end connected to resistor R3 and the emitter of transistor Q1, and a second end connected to ground.

In operation, the resistances of resistors R1 and R2 are equal, and develop voltages at the collectors of transistors Q1 and Q2 which are equal when the collector currents are equal. When the collector currents, which are proportional to absolute temperature, are not equal, op amp 210 responds to the unequal collector voltages by changing the base voltages of transistors Q1 and Q2 until the collector currents of transistors Q1 and Q2 are equal.

In circuit 200, transistors Q1 and Q2 are again forced to operate with unequal emitter current densities due to the difference in emitter areas. As a result, the difference voltage $\Delta V_{BE}$ is again equal to the voltage VR3 across resistor R3, and the voltage VR3 again has a positive temperature coefficient.

The voltage VR3 across resistor R3 defines the emitter current $I_{EQ2}$ of transistor Q2. As a result, the emitter current $I_{EQ2}$ is proportional to the difference voltage $\Delta V_{BE}$, and must have a positive temperature coefficient.

Since the collector currents, the base currents, and the betas of transistors Q1 and Q2 are nominally the same, the emitter current $I_{EQ1}$ of transistor Q1 is nominally the same as the emitter current $I_{EQ2}$ of transistor Q2. Thus, the emitter current $I_{EQ1}$ of transistor Q1 is also proportional to the difference voltage $\Delta V_{BE}$.

Since both the emitter current $I_{EQ1}$ of transistor Q1 and the emitter current $I_{EQ2}$ of transistor Q2 are proportional to the difference voltage $\Delta V_{BE}$, the combined currents through resistor R4 must also be proportional to the difference voltage $\Delta V_{BE}$, and must also have a positive temperature coefficient.

Since the combined emitter currents have a positive temperature coefficient, the voltage VR4 across resistor R4 must also have a positive temperature coefficient. Thus, by properly sizing resistor R4 to obtain the proper gain, the amplified difference voltage $\Delta AV_{BE}$ is defined across resistor R4.

In circuit 200, the amplified difference voltage $\Delta AV_{BE}$ (the voltage VR4) is summed with the base-to-emitter voltage $V_{BEQ1}$ of transistor Q1 to produce the reference voltage $V_{REF}$. The base-to-emitter voltage $V_{BEQ1}$ of transistor Q1 has a negative temperature coefficient as op amp 210 insures that transistor Q1 receives a collector current that is proportional to absolute temperature. (See also U.S. Pat. No. 3,887,863 to Browkaw which is hereby incorporated by reference.)

Although circuits 100 and 200 output reference voltages $V_{REF}$ which are, to a first degree, constant over variations in temperature, in actual practice the reference voltages $V_{REF}$ vary slightly with changes in temperature. Thus, with the need to produce highly-accurate, low-voltage reference voltages, there is a need for a bandgap voltage reference circuit that reduces these slight changes in the reference voltage $V_{REF}$ over changes in temperature.

SUMMARY OF THE INVENTION

The present invention provides a bandgap voltage reference circuit that reduces variations in the reference voltage $V_{REF}$ over temperature by significantly increasing the magnitude of the difference voltage $\Delta V_{BE}$. By increasing the magnitude of the difference voltage $\Delta V_{BE}$, a smaller gain can be used to form the amplified difference voltage $\Delta AV_{BE}$. By utilizing a smaller gain, less of the error associated with the difference voltage $\Delta AV_{BE}$ is present in the amplified difference voltage $\Delta AV_{BE}$.

In accordance with the present invention, a voltage reference circuit includes a current source that outputs a first current and a second current, and a difference circuit that is connected to the current source. The difference circuit has a first transistor which has a collector connected to receive the first current, a base, and an emitter that outputs a first emitter current.

The difference circuit also includes a second transistor which has a collector connected to receive the second current, a base connected to the base of the first transistor, and an emitter. The voltage on the base of the first transistor and the base of the second transistor is defined by a voltage on the collector of the second transistor. The difference circuit further includes a third transistor which has a collector connected to the emitter of the first transistor, a base connected to receive a voltage defined by a voltage on the collector of the third transistor, and an emitter.

The difference circuit additionally includes a fourth transistor which has a collector connected to the emitter of the second transistor, a base connected to receive a voltage defined by a voltage on the collector of the fourth transistor, and an emitter. Further, a first resistor has a first end connected to the emitter of the third transistor, and a second end connected to the emitter of the fourth transistor. A difference voltage, which has a positive temperature coefficient, is formed across the first resistor.

A better understanding of the features and advantages of the present invention will be obtained by reference to the following detailed description and accompanying drawings which set forth an illustrative embodiment in which the principles of the invention are utilized.

DETAILED DESCRIPTION

Figure 1:
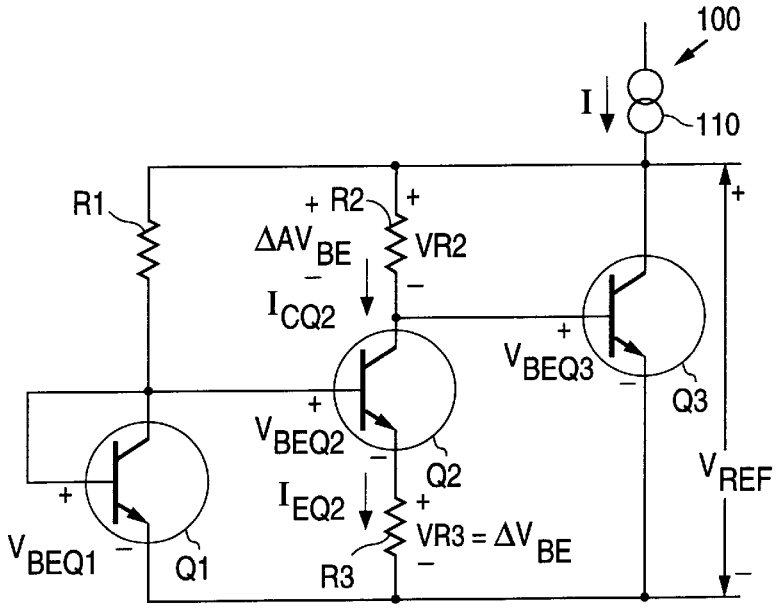
FIG. 1 (PRIOR ART)
FIG. 1 is a schematic diagram illustrating a conventional bandgap voltage reference circuit 100.
Figure 2:
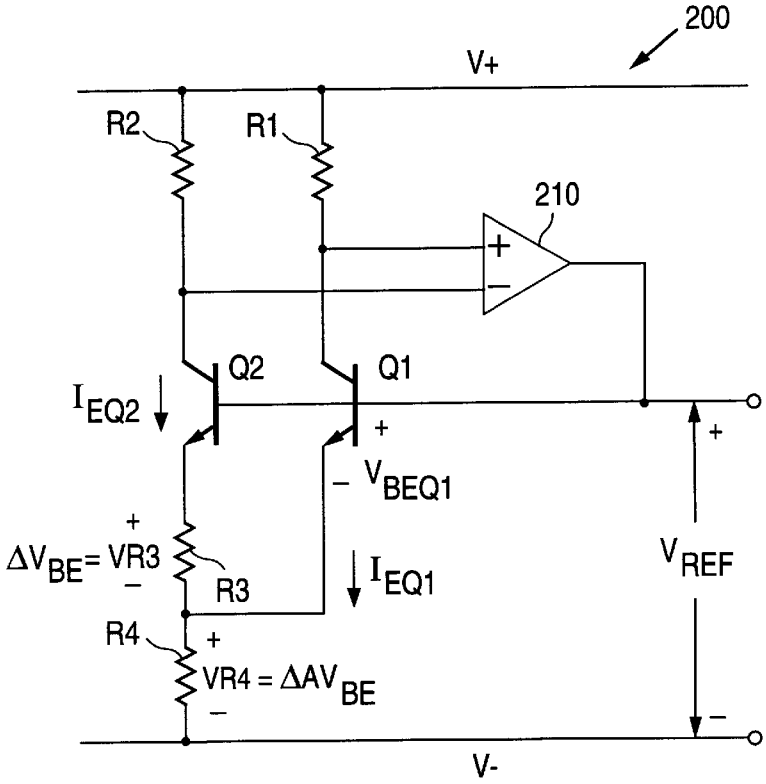
FIG. 2 (PRIOR ART)
FIG. 2 is a schematic diagram illustrating a conventional bandgap voltage reference circuit 200.
Figure 3:
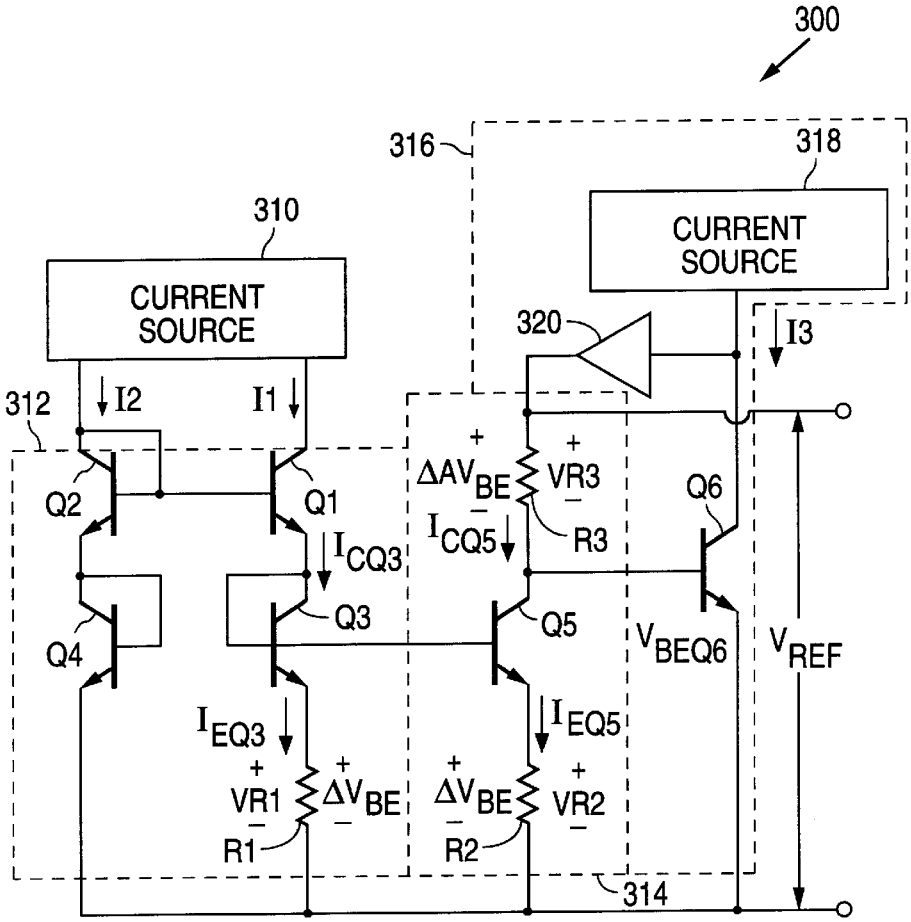
FIG. 3 is a schematic diagram illustrating a bandgap voltage reference circuit 300 in accordance with the present invention.

FIG. 3 shows a schematic diagram that illustrates a bandgap voltage reference circuit 300 in accordance with the present invention. As shown in FIG. 3, circuit 300 includes a current source circuit 310 that outputs a first current I1 and second current I2 which has a magnitude defined by current I1, and a difference circuit 312 that is connected to current source 310. Circuit 312, in turn, includes a transistor Q1 which has a collector connected to receive the first current I1, a base, and an emitter.

Difference circuit 312 further includes a transistor Q2 which has a collector connected to receive the second current I2, a base connected to the base of transistor Q1 and the collector of transistor Q2, and an emitter. In addition, transistor Q1 is formed to have an emitter area that is N times larger than the emitter area of transistor Q2.

Further, difference circuit 312 also includes a transistor Q3 which has a collector connected to the emitter of transistor Q1, a base connected to the collector of transistor Q3, and an emitter. In addition, a transistor Q4 has a collector connected to the emitter of transistor Q2, a base connected to the collector of transistor Q4, and an emitter.

In circuit 312, transistor Q3 is formed to have an emitter area that is N times larger than the emitter area of transistor Q4, while transistor Q4 is formed to have an emitter area that is equal to the emitter area of transistor Q2.

Difference circuit 312 additionally includes a resistor R1 which has a first end connected to the emitter of transistor Q3, and a second end connected to the emitter of transistor Q4. As described in greater detail below, difference circuit 312 develops a difference voltage $\Delta V_{BE}$, which has a positive temperature coefficient, across resistor R1.

As further shown in FIG. 3, circuit 300 also includes an amplification circuit 314 that is connected to difference circuit 312. Amplification circuit 314 includes a transistor Q5 that has a collector, a base connected to the base of transistor Q3, and an emitter. Transistor Q5 has an emitter area that is equal to the size of the emitter area of transistor Q3.

Amplification circuit 314 also includes a second resistor R2 having a first end connected to the emitter of transistor Q5, a second end connected to the second end of resistor R1, and a resistance equal to the resistance of resistor R1. In addition, a third resistor R3 has a first end connected to the collector of transistor Q5, and a second end.

As described in greater detail below, amplification circuit 314 develops the difference voltage $\Delta V_{BE}$ across resistor R2, and an amplified difference voltage $\Delta AV_{BE}$ across resistor R3. Thus, since the difference voltage $\Delta V_{BE}$ has a positive temperature coefficient, the amplified difference voltage $\Delta AV_{BE}$ also has a positive temperature coefficient.

In addition, circuit 300 further includes an output circuit 316 that is connected to amplification circuit 314. Circuit 316 includes an output transistor Q6 which has a collector connected to receive a current, a base connected to the collector of transistor Q5, and an emitter connected to the second end of resistor R2.

In addition, transistor Q6 has a base-to-emitter voltage $V_{BEQ6}$ which has a negative temperature coefficient. The magnitudes of the positive and negative temperature coefficients are substantially the same.

Output circuit 316 also includes a current source 318 that outputs a current I3 which is proportional to absolute temperature (PTAT), and a buffer 320 having an input connected to the collector of transistor Q6, and an output connected to the second end of resistor R3.

In operation, the output circuit 316 outputs a reference voltage $V_{REF}$ that is the sum of the amplified difference voltage $\Delta AV_{BE}$ and the base-to-emitter voltage $V_{BEQ6}$.

Since the amplified difference voltage $\Delta AV_{BE}$ and the base-to-emitter voltage $V_{BEQ6}$ have equal but opposite temperature coefficients, changes in temperature cause the amplified difference voltage $\Delta AV_{BE}$ and the base-to-emitter voltage $V_{BEQ6}$ to vary in equal and opposite directions, thereby leaving the reference voltage $V_{REF}$ unchanged.

For example, if the amplified difference voltage $\Delta AV_{BE}$ has a temperature coefficient of +2 mV/° C. and the base-to-emitter voltage $V_{BEQ6}$ has a temperature coefficient of −2 mV/° C., then a one degree increase in temperature raises the amplified difference voltage $\Delta AV_{BE}$ by 2 mV while lowering the base-to-emitter voltage $V_{BEQ6}$ by 2 mV, thereby leaving the reference voltage $V_{REF}$, the sum of the voltages, unchanged.

The amplified difference voltage $\Delta AV_{BE}$, which is dropped across resistor R3, is developed by utilizing bipolar transistors which are forced to operate with emitter currents that have unequal current densities. As noted above, when bipolar transistors operate with unequal emitter current densities, the difference voltage between the base-to-emitter voltages of the transistors has a positive temperature coefficient.

In circuit 300, when first and second currents I1 and I2 are equal, transistors Q1/Q3 and Q2/Q4 are forced to operate with unequal emitter current densities since transistors Q1 and Q3 have emitter areas that are N times larger than the emitter areas of transistors Q2 and Q4, respectively.

As a result, the difference voltage $\Delta V_{BE}$, which has a positive temperature coefficient, is defined as the difference between the combined base-to-emitter voltages of transistors Q2 and Q4; and the combined base-to-emitter voltages of transistors Q1 and Q3, i.e., $\Delta V_{BE}=(V_{BEQ2}+V_{BEQ4})-(V_{BEQ1}+V_{BEQ3})$.

As shown in FIG. 3, the combined base-to-emitter voltages $V_{BEQ2}$ and $V_{BEQ4}$ of transistors Q2 and Q4 are equal to the combined base-to-emitter voltages $V_{BEQ1}$ and $V_{BEQ3}$ of transistors Q1 and Q3, and a voltage VR1 across resistor R1, i.e., $V_{BEQ2}+V_{BEQ4}=V_{BEQ1}+V_{BEQ3}+VR1$. Rearranging yields $(V_{BEQ2}+V_{BEQ4})-(V_{BEQ1}+V_{BEQ3})=VR1$.

Since the difference voltage $\Delta V_{BE}$ is equal to the difference between the base-to-emitter voltages ($\Delta V_{BE}=(V_{BEQ2}+V_{BEQ4})-(V_{BEQ1}+V_{BEQ3})$), the difference voltage $\Delta V_{BE}$ is also equal to the voltage VR1 across resistor R1. In addition, since the difference voltage $\Delta V_{BE}$ has a positive temperature coefficient, the voltage VR1 across resistor R1 must also have a positive temperature coefficient.

Since the difference voltage $\Delta V_{BE}$ is equal to the voltage VR1 across resistor R1, the emitter current $I_{E3}$ flowing through resistor R1 is proportional to the difference voltage $\Delta V_{BE}$ and, therefore, must have a positive temperature coefficient.

Further, the collector current $I_{CQ3}$ of transistor Q3 is approximately equal to the emitter current $I_{E3}$ of transistor Q3 due to the beta of transistor Q3. As a result, the collector current $I_{CQ3}$ is approximately proportional to the difference voltage $\Delta V_{BE}$ and, therefore, must have a positive temperature coefficient.

Transistors Q3 and Q5 form a resistor-ratioed current mirror. Since transistors Q3 and Q5 have the same-sized emitter areas, resistors R1 and R2 provide equal resistances, and the current mirror configuration forces the base-to-emitter voltages $V_{BE}$ of transistors Q3 and Q5 to be equal, the emitter current $I_{EQ5}$ and the collector current $I_{CQ5}$ of transistor Q5 are the same as the emitter current $I_{EQ3}$ and collector current $I_{C3}$ of transistor Q3, respectively.

Since the emitter current $I_{EQ5}$ is the same as the emitter current $I_{EQ3}$, and the resistances of resistors R1 and R2 are the same, the voltage VR2 across resistor R2 is also equal to the difference voltage $\Delta V_{BE}$.

Further, the collector current $I_{CQ5}$ of transistor Q5 is approximately equal to the emitter current $I_{E5}$ of transistor Q5 due to the beta of transistor Q5. As a result, the collector current $I_{CQ5}$ is proportional to the difference voltage $\Delta V_{BE}$ and, therefore, must have a positive temperature coefficient.

In addition, since the collector current $I_{CQ5}$ has a positive temperature coefficient, the voltage VR3 across resistor R3, i.e., the amplified difference voltage $\Delta AV_{BE}$, must also have a positive temperature coefficient. Since the collector current $I_{CQ5}$ is approximately equal to the emitter current $I_{EQ5}$, the amplified difference voltage $\Delta AV_{BE}$ is equal to the resistor ratio R3/R2 times the difference voltage $\Delta V_{BE}$.

As noted above, the amplified difference voltage $\Delta AV_{BE}$ is summed with the base-to-emitter voltage $V_{BEQ6}$ to produce the reference voltage $V_{REF}$. Since the current I3 output by current source 318 is proportional to absolute temperature, the base-to-emitter voltage $V_{BEQ6}$ of transistor Q6 changes only with temperature, and decreases as temperature increases.

Thus, by setting the positive and negative temperature coefficients of the amplified difference voltage $\Delta AV_{BE}$ and the base-to-emitter voltage $V_{BEQ6}$ to be equal, changes in temperature cause the amplified difference voltage $\Delta AV_{BE}$ and the base-to-emitter voltage $V_{BEQ6}$ to vary in equal and opposite directions, thereby leaving the reference voltage $V_{REF}$ unchanged.

One of the advantages of the present invention is that the present invention significantly increases the magnitude of the difference voltage $\Delta V_{BE}$. The base-to-emitter voltage $V_{BEQ6}$ of transistor Q6 is approximately 625 mV@50° C. Thus, to provide a positive temperature coefficient that matches the negative temperature coefficient of the base-to-emitter voltage $V_{BEQ6}$ of transistor Q6, 625 mV@50° C. must also be dropped across resistor R3.

In circuit 100, approximately 64.2 mV@50° C. is dropped across resistor R3 when the current densities differ by a factor of 10. Similarly, approximately 64.2 mV@50° C. is dropped across resistor R3 in circuit 200 when the ratio of the emitter area A2 of transistor Q2 to the emitter area A1 of transistor Q1 is 10, i.e., A2/A1=10.

As noted above, in circuit 100, the amplified difference voltage $\Delta AV_{BE}$ (VR2) is equal to the resistor ratio R2/R3 times the difference voltage $\Delta V_{BE}$. Thus, in circuit 100, a resistor ratio of 9.7 is needed to amplify the 64.2 mV to 625 mV. The difference voltage $\Delta V_{BE}$ typically varies by approximately ±2.66 mV (based on a statistical estimate). Thus, after being amplified 9.7 times, the amplified difference voltage $\Delta AV_{BE}$ across resistor R2 in circuit 100 varies by approximately ±25.802 mV.

In accordance with the present invention, as shown in FIG. 3, since transistors Q1 and Q3 have the same-sized emitter areas, and transistors Q2 and Q4 have the same-sized emitter areas, transistors Q3 and Q4 double the magnitude of the difference voltage $\Delta V_{BE}$ (VR1 across resistor R1 and VR2 across resistor R2) to approximately 128.4 mV@50° C. (when currents I1 and I2 are equal).

Thus, to cancel the negative temperature coefficient of the base-to-emitter voltage $V_{BEQ6}$ of transistor Q6, the 128.4 mV dropped across resistor R2 in circuit 300 must be amplified by approximately 4.9 to obtain the same 625 mV. As a result, the amplified difference voltage $\Delta AV_{BE}$ across resistor R3 in circuit 300 only varies by approximately ±12.9 mV, a 50% reduction over the prior art.

In the preferred embodiment of the present invention, first and second currents I1 and I2 are not equal. Instead, second current I2 is L times larger than first current I1. By setting second current I2 to be L times larger than first current I1, the emitter current densities of transistors Q2/Q4 are not just N times larger than the emitter current densities of transistors Q1/Q3, but are L*N times larger.

This further increases the magnitude of the difference voltage $\Delta V_{BE}$ (VR1 across resistor R1 and VR2 across resistor R2) which is defined in equation 1 as:

$$\Delta V_{BE}=2V_T(\ln(L^*N)) \quad \text{EQ. 1}$$

where $V_T$ is the thermal voltage kT/q.

For N=L=8, the difference voltage $\Delta V_{BE}$ is approximately 232 mV@50° C. As a result, the gain required to amplify 232 mV to 625 mV is only 2.7. Thus, in this example, the amplified difference voltage $\Delta AV_{BE}$ across resistor R3 varies by approximately ±7.18 mV.

Another advantage of the present invention is that circuit 300 can be easily trimmed. As discussed above, resistors R1 and R2 are nominally the same. However, by modifying the resistance provided by resistor R2, the magnitude of the collector current $I_{CQ5}$ can be adjusted as needed.

Figure 4:
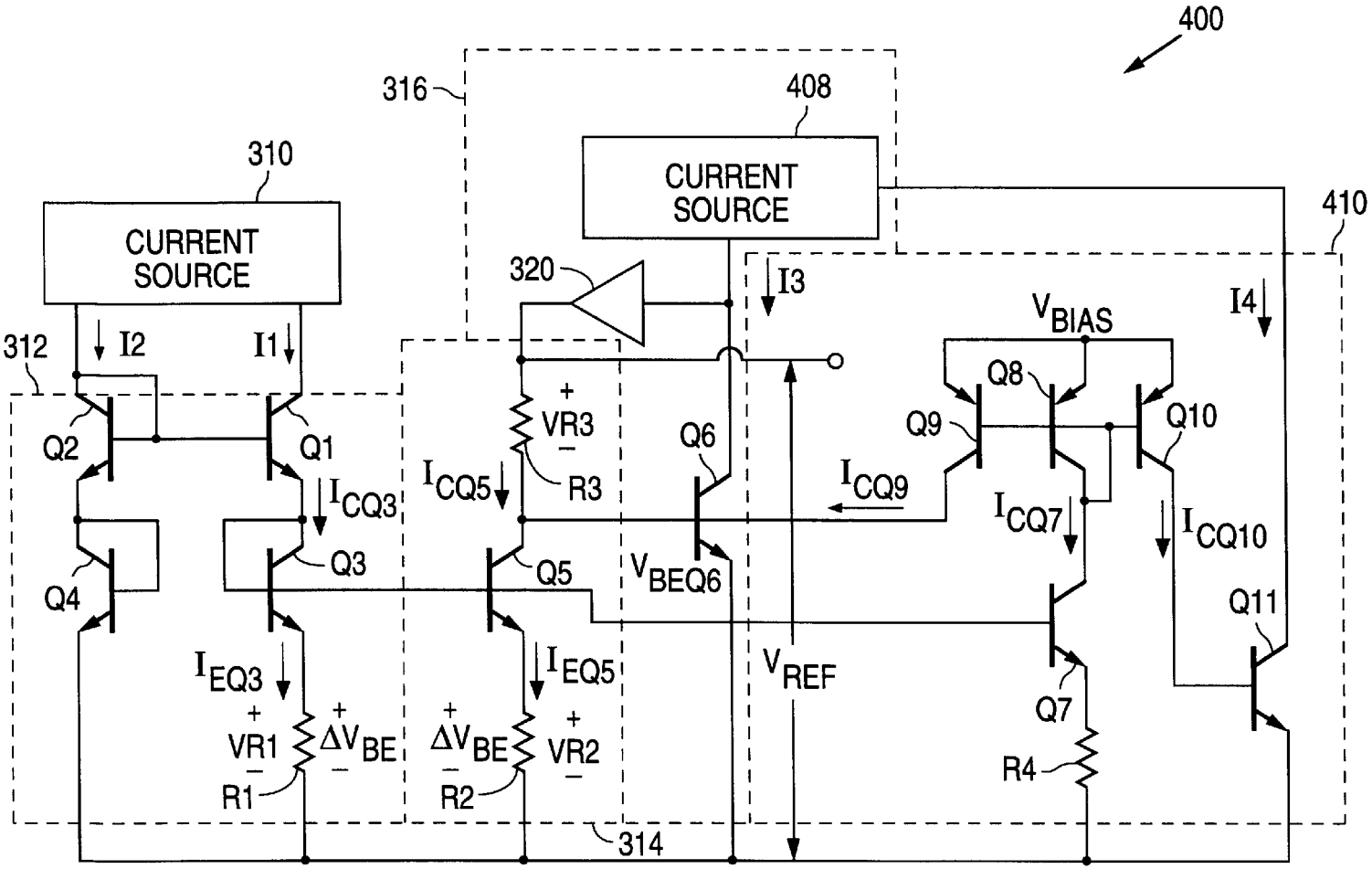
FIG. 4 is a schematic diagram illustrating a voltage reference circuit 400 in accordance with the present invention.

FIG. 4 shows a schematic diagram that illustrates a voltage reference circuit 400 in accordance with the present invention. Circuit 400 is similar to circuit 300 and, as a result, utilizes the same reference numerals to designate the structures which are common to both circuits.

As shown in FIG. 4, circuit 400 differs from circuit 300 in that circuit 400 includes a current source 408 that outputs a current I4 which defines the magnitude of current I3. Circuit 400 also differs from circuit 300 in that circuit 400 includes a base width compensation circuit 410 which is connected to output circuit 316. Circuit 410 reduces variations in the base-to-emitter voltage $V_{BE6}$ of transistor Q6 by reducing the effect of the base width on the base-to-emitter voltage $V_{BE6}$.

The base-to-emitter voltage $V_{BE6}$ of transistor Q6 is given by equation 2 as:

$$V_{BE6}=(kT/q)\ln(I_{CQ6}/I_{S6}) \quad \text{EQ. 2}$$

where $I_{CQ6}$ represents the collector current of transistor Q6, and $I_{S6}$ represents the substrate current of transistor Q6.

The collector current $I_{CQ6}$, in turn, is highly influenced by variations in the base width of transistor Q6 due to the relationship between the collector current $I_{CQ6}$ and the beta of transistor Q6 ($i_B\beta=i_C$). Beta β is given by equation 3 as:

$$1/\beta=((W_B/L_{PB})^2)/2+(N_{DB}W_BD_{nE})/(D_{PB}N_{AE}W_E)+(W_{EB}/\tau_0)(N_{DB}W_B/D_{PB}2n_ie^{qVeb/2kT}) \quad \text{EQ. 3}$$

where $W_B$ represents the base width, $L_{PB}$ represents the diffusion length of the minority carriers in the base region, $N_{DB}$ represents the donor concentration within the base region, $D_{nE}$ represents the diffusivity of electrons in the emitter, $D_{PB}$ represents the diffusivity of holes in the base region, $N_{AE}$ represents the acceptor concentration in the emitter, $W_E$ represents the emitter depth, $W_{EB/\tau}$ represents the recombination factor, and $2n_i e^{qVeb/2kT}$ represents the recombination rate. (Also see "The Physics and Technology of Semiconductor Devices", page 220, A. S. Grove which is hereby incorporated by reference.)

In addition, the substrate current $I_{S6}$ is also influenced by variations in the base width of transistor Q6, and is given by equation 4 as:

$$I_{S6}=qAn_{PO}D_N/W_B \quad \text{EQ. 4}$$

where q represents the charge of an electron, A represents the effective emitter area of transistor Q6, $n_{PO}$ represents the equilibrium concentration of electrons in the base, and $D_N$ represents the electron diffusion constant.

Since both the collector current $I_{CQ6}$ and the substrate current $I_{S6}$ are influenced by variations in the base width $W_B$ of transistor Q6, variations in the base width $W_B$ of transistor Q6 also cause variations in the base-to-emitter voltage $V_{BE6}$ of transistor Q6 which, in turn, causes variations in the reference voltage $V_{REF}$.

Returning to FIG. 4, circuit 410 includes an amplifying transistor Q7, current dividing transistors Q8–Q10, an amplifying transistor Q11, and a resistor R4. Transistor Q7, which is formed to have an emitter area that is the same size as the emitter area of transistor Q4, has a collector, a base connected to the base of transistors Q3 and Q5, and an emitter.

Resistor R4, in turn, has a first end connected to the emitter of transistor Q7 and a second end connected to the second end of resistor R2, and has a resistance which is N times larger than the resistance provided by resistors R1 and R2.

Transistor Q8 has a collector and a base connected to the collector of transistor Q7, and an emitter connected to a bias voltage $V_{BIAS}$. Transistor Q9 has a collector connected to the base of transistor Q6, a base connected to the base of transistor Q8, and an emitter connected to the bias voltage $V_{BIAS}$.

Transistor Q10 has a collector, a base connected to the base of transistor Q8, and an emitter connected to the bias voltage $V_{BIAS}$. Transistors Q9 and Q10 have collector areas that are the 1/Mth the size as the collector area of transistor Q8. Further, transistor Q11, which is matched to transistor Q6, has a collector connected to current source 408 to receive the current I4, a base connected to the collector of transistor Q10, and an emitter connected to the second end of resistor R2.

Transistors Q3, Q5, and Q7 also form a resistor-ratioed current mirror. Since transistor Q7 has an emitter area that is 1/Nth the size of the emitter areas of transistors Q3 and Q5, resistor R4 provides a resistance that is N times larger than resistors R1 and R2, and the current mirror configuration forces the base-to-emitter voltages $V_{BE}$ of transistors Q3, Q5, and Q7 to be equal, the collector current $I_{CQ7}$ of transistor Q7 is 1/Nth the size of the collector current $I_{CQ5}$ of transistor Q5.

The collector current $I_{CQ7}$ of transistor Q7 is divided by M by transistors Q8–Q10, utilizing collector area ratioing, to produce two matched collector currents $I_{CQ9}$ and $I_{CQ10}$. Thus, the collector current $I_{CQ9}$, which provides the base current for transistor Q6, and the collector current $I_{CQ10}$, which provides the base current for transistor Q11, are both equal to the collector current of transistor Q5 divided by M*N ($I_{CQ5}$/M*N). (The value N*M can be chosen to be equal to the nominal (npn) beta of the process.)

The beta of transistor Q11, which is nominally the same as the beta of transistor Q6, defines the collector current of transistor Q11. Current source 408, in turn, forms the current I3 by mirroring the current I4 so that the collector current $I_{CQ6}$ of transistor Q6 matches the collector current $I_{CQ11}$ of transistor Q11.

Thus, since the base and collector currents of transistor Q6 are defined, the beta of transistor Q6 is also defined ($i_c/i_B=\beta$). The underlying assumption is that the substrate current is inversely proportional to beta. This assumption, however, is not exact. As a result, defining the beta of transistor Q6 in this manner reduces by approximately one-half the variation in the base-to-emitter voltage $V_{BE6}$ (EQ. 2) due to the influence of the base width $W_B$. The compensation that is provided to the base-to-emitter voltage $V_{BE6}$, however, is precise to within the beta matching of transistors Q6 and Q11 when operated under identical conditions.

Conventionally, the base-to-emitter voltage $V_{BE}$ of a transistor varies by approximately +18 mV at 50° C. due to the influence of the base width $W_B$ when the diffused regions are formed by chemical doping processes, and by approximately ±4 mV at 50° C. when the diffused regions are formed by ion implantation processes.

Thus, circuit 410 reduces the variation in the base-to-emitter voltage $V_{BE}$ of transistor Q6 to approximately ±9 mV at 50° C. when the diffused regions are formed by chemical doping processes, and to approximately ±2 mV at 50° C. when the diffused regions are formed by ion implantation processes.

As with circuit 300, circuit 400 can also be easily trimmed. As discussed above, resistors R1 and R2 are nominally the same, while resistor R4 is N times larger. By modifying the resistance provided by resistor R4, the magnitudes of the collector current $I_{CQ7}$ can be adjusted as needed.

Figure 5:
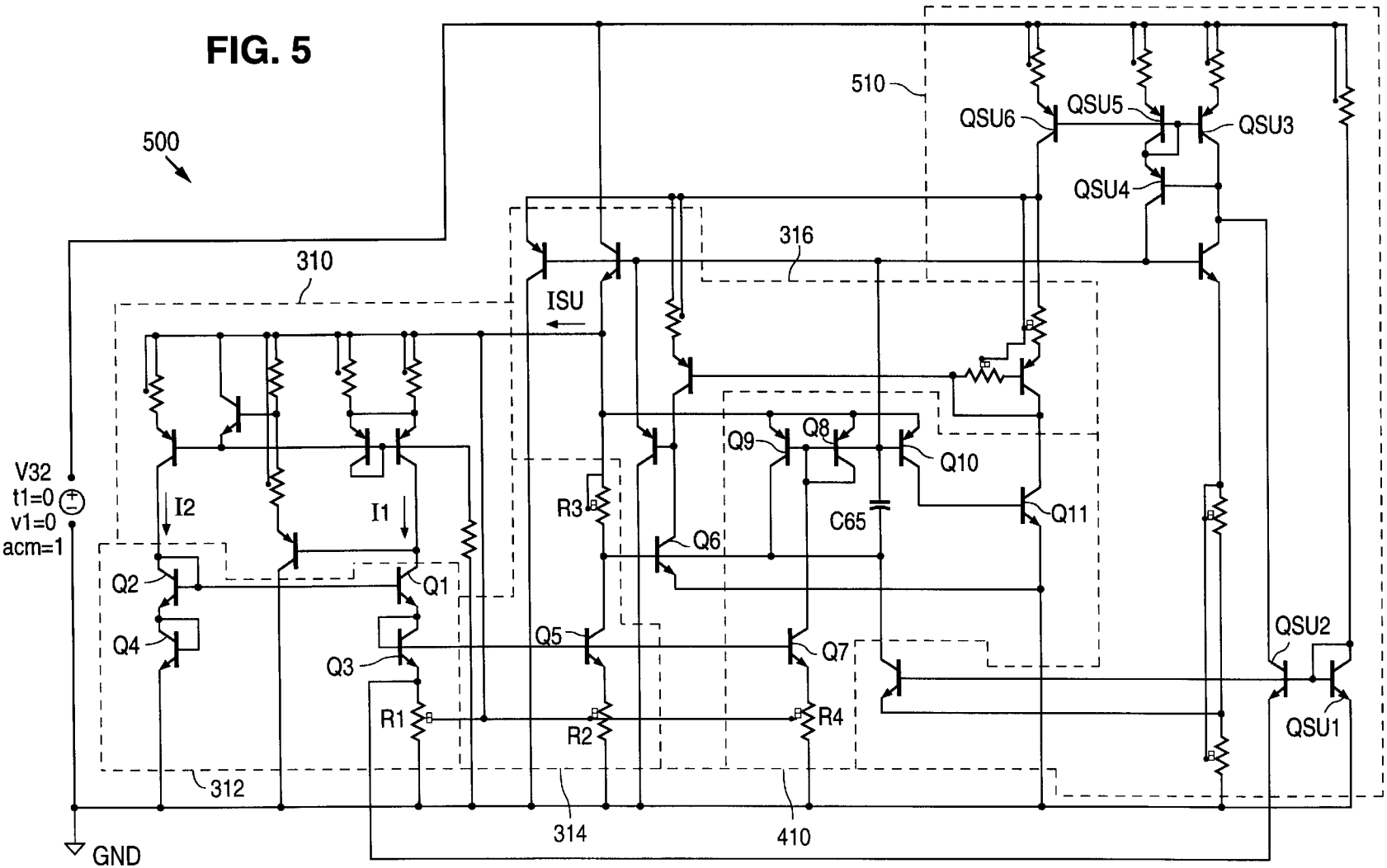
FIG. 5 is a schematic diagram illustrating a voltage reference circuit 500 in accordance with the present invention.

FIG. 5 shows a schematic diagram that illustrates a voltage reference circuit 500 in accordance with the present invention. Circuit 500 is an example of a specific embodiment of circuit 400 when circuit 400 is operated with substantially equal first and second currents I1 and I2.

As shown in FIG. 5, circuit 500 includes a start-up circuit 510 that insures that the difference voltage $\Delta V_{BE}$ is developed across resistor R1 when power is applied. In operation, when the difference voltage $\Delta V_{BE}$ is collapsed to ground (the off condition), transistor QSU2 sinks current from the PNP current source transistors QSU3–QSU6 which, in turn, causes a current ISU to flow into current source 310 from output circuit 316.

Figure 6:
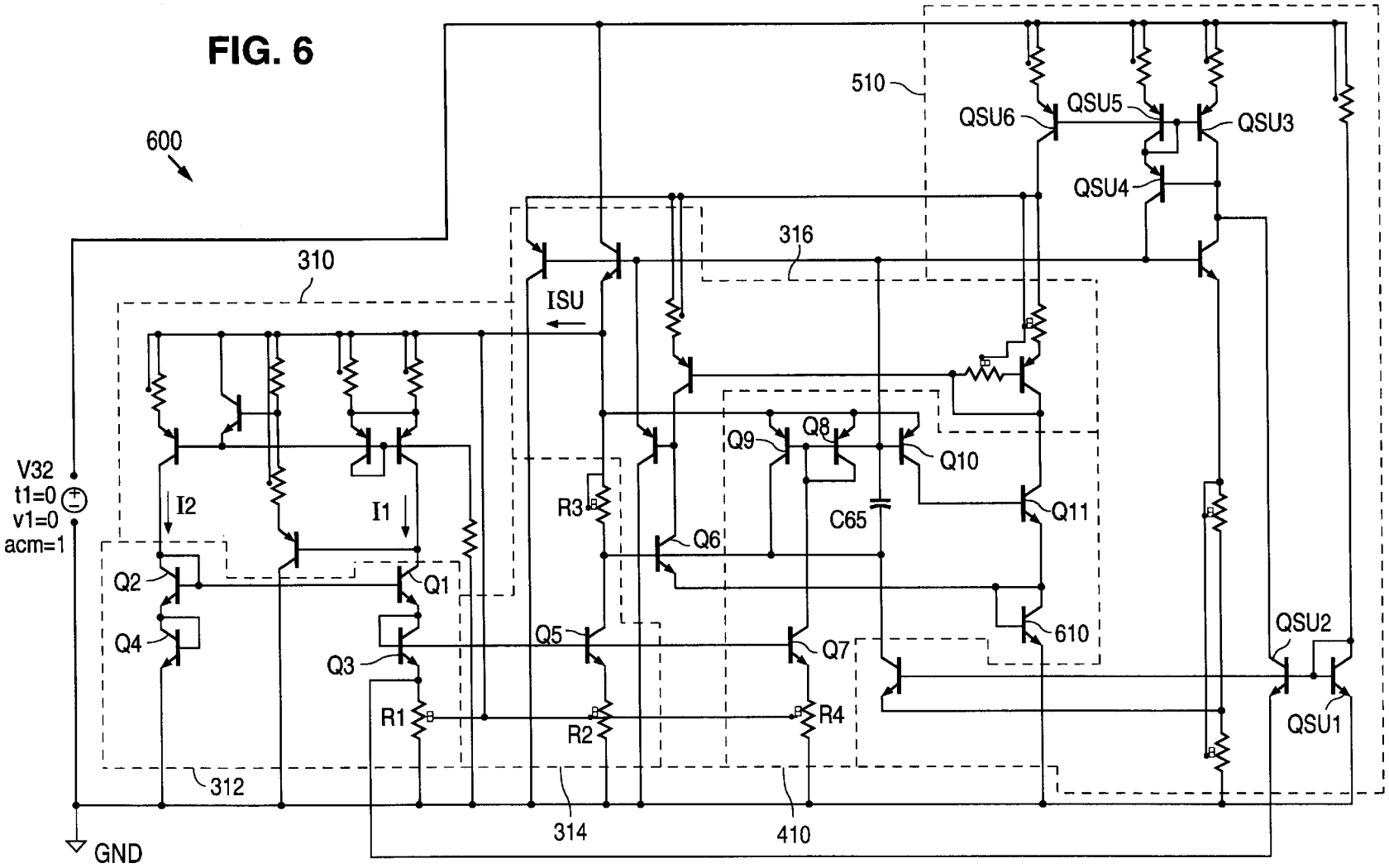
FIG. 6 is a schematic diagram illustrating a voltage reference circuit 600 in accordance with the present invention.

FIG. 6 shows a schematic diagram that illustrates a voltage reference circuit 600 in accordance with the present invention. Circuit 600 is another example of a specific embodiment of circuit 400 when circuit 400 is operated with the second current I2 being L times greater than the first current I1. Circuit 600 is similar to circuit 500 and, as a result, utilizes the same reference numerals to designate the structures which are common to both circuits.

As shown in FIG. 6, circuit 600 differs from circuit 500 in that circuit 600 includes a saturation prevention transistor 610 which is placed between transistors Q6 and Q11, and ground. When the second current I2 is larger than the first current I1, transistor Q5 can saturate. Transistor 610 prevents this from happening, and also doubles the value of the reference voltage $V_{REF}$, i.e., from 1.25 volts to 2.50 volts.

Figure 7:
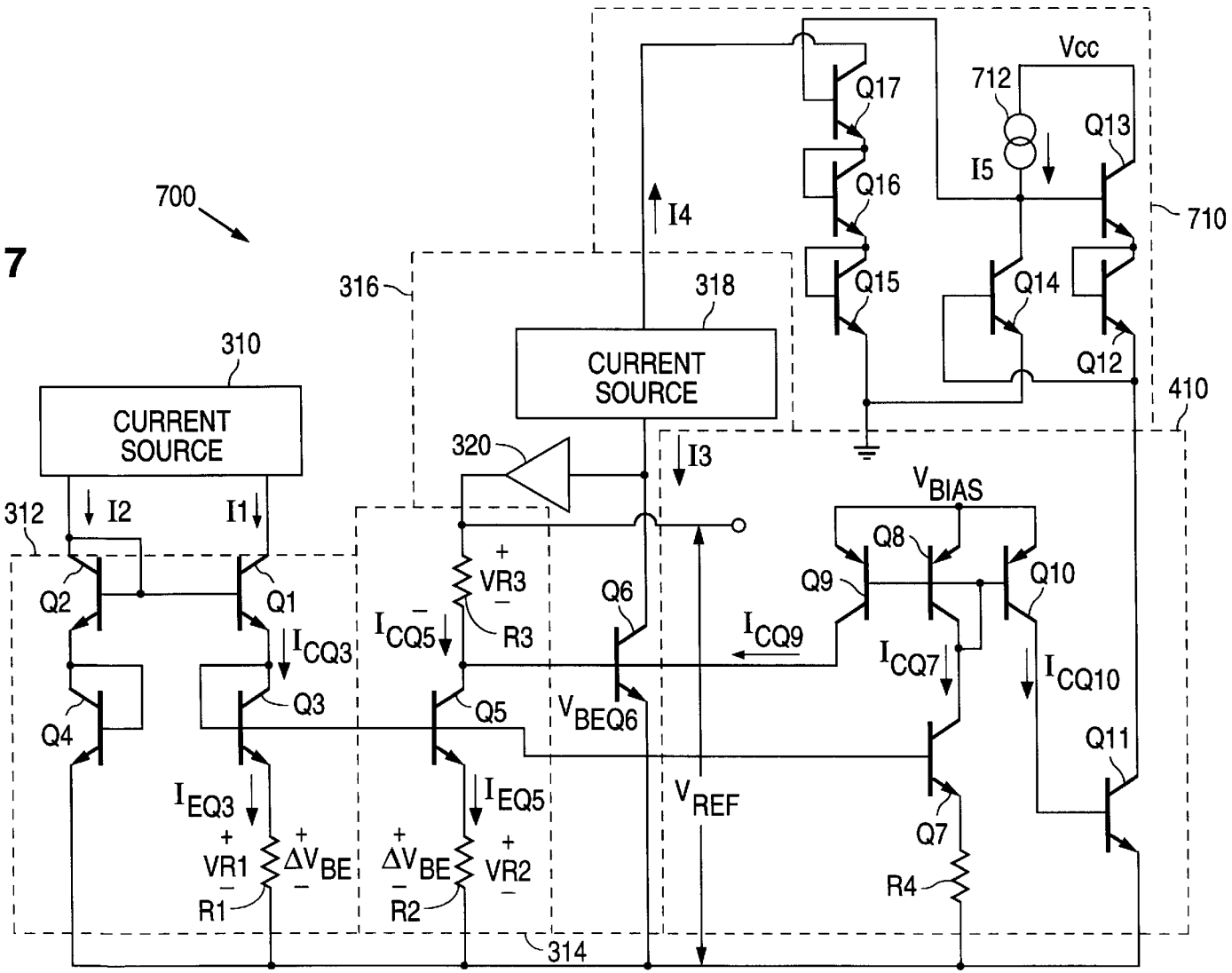
FIG. 7 is a schematic diagram illustrating a voltage reference circuit 700 in accordance with the present invention.

FIG. 7 shows a schematic diagram that illustrates a voltage reference circuit 700 in accordance with the present invention. Circuit 700 is similar to circuit 400 and, as a result, utilizes the same reference numerals to designate the structures which are common to both circuits.

As shown in FIG. 7, circuit 700 differs from circuit 400 in that circuit 700 includes a base width compensation circuit 710 which is connected to circuit 316. As noted above, the compensation provided to the base-to-emitter voltage $V_{BE6}$ by compensation circuit 410 is based on the assumption that the substrate current is inversely proportional to beta.

Experimentally, the base-to-emitter voltage $V_{BE}$ of transistor Q6 has been found to vary as the $-2/3$ power of beta β (this corresponds to about equal contributions from the linear and squared base width $W_B$ terms in equation 3). Circuit 710 provides this compensation and, as a result, substantially eliminates the variation in the base-to-emitter voltage $V_{BE}$ of transistor Q6.

Circuit 710 includes a transistor Q12 that has a collector, a base connected to the collector, and an emitter connected to the collector of transistor Q11; and a transistor Q13 that has a collector connected to a voltage Vcc, a base, and an emitter connected to the collector of transistor Q12.

In addition, circuit 710 also includes a transistor Q14 which has a collector, a base connected to the emitter of transistor Q12, and an emitter; and a current source 712 which has a first end connected to the voltage Vcc, and a second end connected to the base of transistor Q13 and the collector of transistor Q14.

Circuit 710 further includes a transistor Q15 that has a collector, a base connected to the collector, and an emitter connected to the emitter of transistor Q14 and ground; a transistor Q16 that has a collector, a base connected to the collector, and an emitter connected to the collector of transistor Q15; and a transistor Q17 that has a collector connected to current source 408, a base connected to the base of transistor Q13, and an emitter connected to the collector of transistor Q16.

In operation, as discussed above with respect to FIG. 4, the base current of transistor Q11 is equal to the collector current of transistor Q5 divided by M*N, i.e., $I_{CQ5}/M*N$. As a result, the collector current of transistor Q11 is equal to $\beta I_{CQ5}/M*N$ (the beta of transistor Q11 times the base current).

Compensation circuit 710 sinks the current I4 from current source 408, which is equal to $I_{CQ5}\ (\beta/M*N)^{2/3}$, and changes the current I4 to be equal to the collector current $\beta I_{CQ5}/M*N$ of transistor Q11. Current source 408 mirrors the current I4 to output the current I3.

As a result, the collector current of transistor Q6 is equal to $I_{CQ5}\ (\beta/M*N)^{2/3}$. Thus, since the collector current of transistor Q6 varies as the $-2/3$ power of beta β, the variation in the base-to-emitter voltage $V_{BE}$ of transistor Q6 is substantially eliminated.

With respect to circuit 710, the collector current of transistor Q11, which is equal to $\beta I_{CQ5}/M*N$, flows through transistors Q12 and Q13. In addition, current source 712 sources a current I5 which flows through transistor Q14. Current I5 is independently derived and is also proportional to absolute temperature. Further, the current I4 flows through transistors Q15–Q17.

The relationship between these currents is given by equation 5 as:

$$(kT/q)[(\ln(I5/I_S)+(2\ln(\beta I_{CQ5}/M*N*I_S))]=3(kT/q)\ln(I4/I_S) \qquad \text{EQ. 5}$$

where kT/q represents the thermal voltage, and $I_S$ represents the substrate current.

Simplifying provides the equality given in equation 6:

$$((I5^3)(\beta/M*N)^2)/I_S^3=I4^3/I_S^3. \qquad \text{EQ. 6}$$

Further simplifying provides equations 7 and 8 as:

$$((I5)^3)(\beta/M*N)^2=I4^3, \qquad \text{EQ. 7 and}$$

$$I4=I5(\beta/M*N)^{2/3}. \qquad \text{EQ. 8}$$

Thus, since the current I4 defines the current I3 (mirrors the current in this case), the current I3 is also equal to $I5(\beta/M*N)^{2/3}$. Since the current I3 varies as the $-2/3$ power of beta β, variations due to the base width of transistor Q6 are effectively eliminated.

Figure 8:
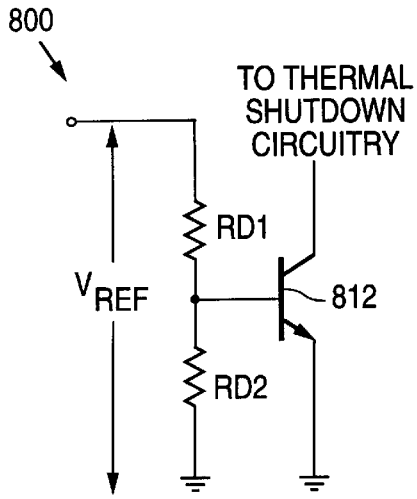
FIG. 8 is a schematic diagram illustrating a thermal shutdown circuit 800 in accordance with the present invention.

Thermal shutdown circuits are frequently used in conjunction with bandgap reference circuits to prevent the destruction of the device under extreme loading or temperature conditions. FIG. 8 shows a schematic diagram that illustrates a thermal shutdown circuit 800 in accordance with the present invention.

As shown in FIG. 8, circuit 800 includes first and second dividing resistors RD1 and RD2. Resistor RD1 has a first end connected to the reference voltage $V_{REF}$, and a second end; while resistor RD2 has a first end connected to the second end of resistor RD1, and a second end connected to ground.

In addition, circuit 800 also includes a sense transistor 812 that has a base connected to the first end of resistor RD2, an emitter connected to ground, and a collector connected to the power dissipating functions of the device.

In operation, a resistively divided fraction of the reference voltage $V_{REF}$ is applied to the base of transistor 812 which, during normal operation, turns off transistor 812. When temperature increases, the base-to-emitter voltage of transistor 812 falls which turns on transistor 812. Further decreases in the base-to-emitter voltage from increasing temperature cause an exponential increase in the collector current which, in turn, shuts down some or all of the power dissipating functions of the device.

It is frequently desirable to have sense transistor 812 placed close to the power devices that are monitored by sense transistor 812, while having circuit 300 or 400 placed away from such devices to minimize thermal gradients that would disturb the circuit.

Since the thermal drift of the base-to-emitter voltage $V_{BE}$ of transistor 812 is −2 mV/° C., the shutdown will occur at some elevated temperature determined by the base voltage. Given that the sensing transistor 812 senses the reference voltage $V_{REF}$, the variation in the conduction of transistor 812 is dependent on the variation in the reference voltage $V_{REF}$.

These combined effects can cause a large variability in the thermal shutdown temperature. If only the reference voltage $V_{REF}$ is trimmed, the remaining variability of circuit 800 is left unaffected. The still fairly large uncertainty in the shutdown temperature is usually tolerated rather than committing more resources for a second trim network.

For circuit 800, if the reference voltage $V_{REF}$ is assumed to have been trimmed, the remaining variability is mostly due to the large range in the base width of transistor 812 which effects the substrate current Is term in the base-to-emitter voltage of transistor 812.

At a typical shutdown temperature of 170° C., a thermal voltage of approximately 38 mV implies that the range of shutdown temperatures is $V_{BEQ6}$/(2 mV/° C.)=(38 mV)ln2/(2 mV/° C.) or about ±13° C. (This is the result for a trimmed bandgap circuit where transistor 812 has been removed from the bandgap circuit area, and has diffusion regions from applied chemicals. When transistor 812 has diffusion regions formed from ion implantation, the result is (38 mV)ln1.2/(2 mV/° C.)=±6.9 mV or about ±3.45° C.)

Figure 9:
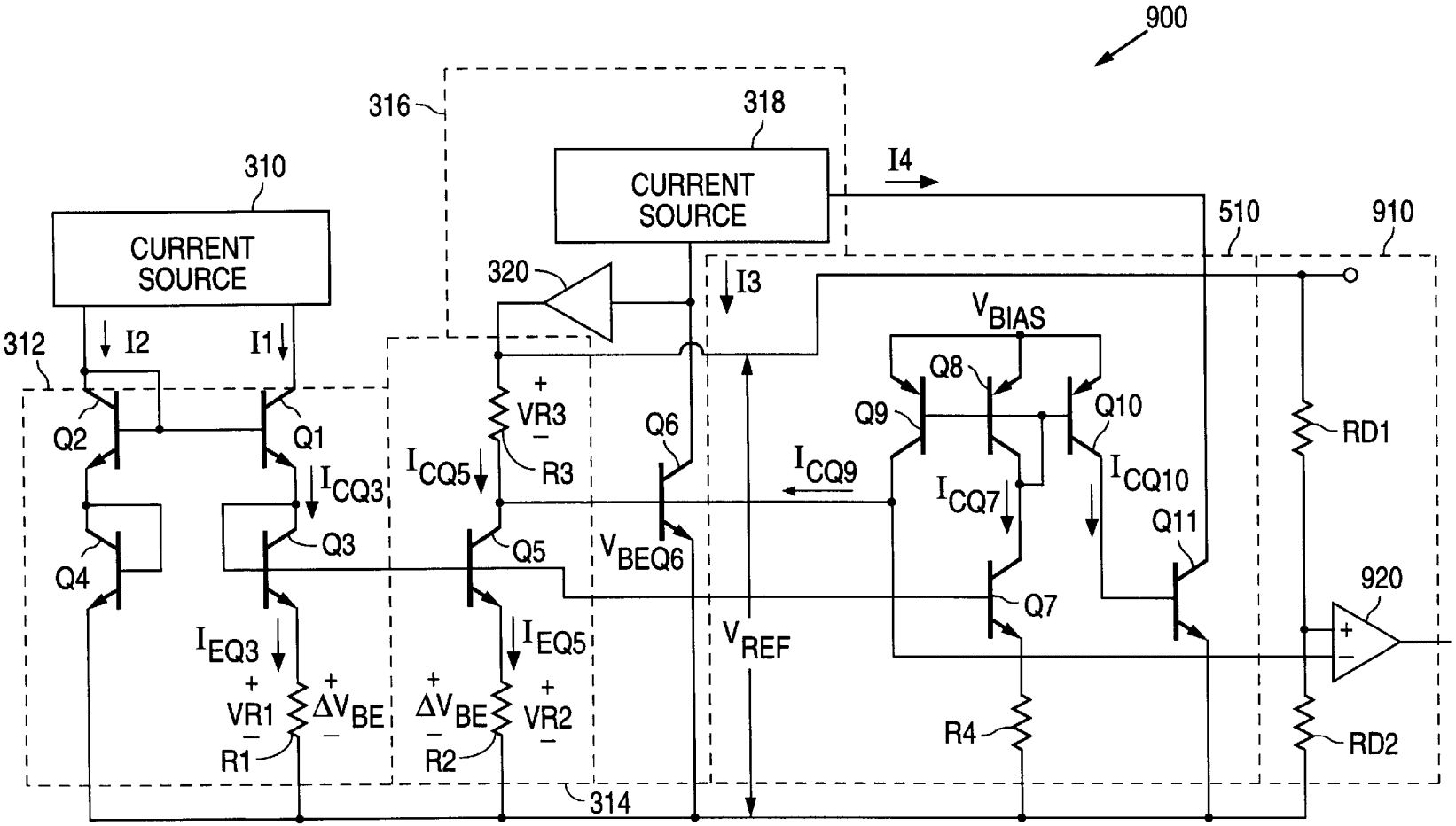
FIG. 9 is a schematic diagram illustrating a bandgap voltage reference circuit 900 in accordance with the present invention.

FIG. 9 shows a schematic diagram that illustrates a bandgap voltage reference circuit 900 in accordance with the present invention. Circuit 900 is similar to circuit 400 and, as a result, utilizes the same reference numerals to designate the structures which are common to both circuits.

As shown in FIG. 9, circuit 900 differs from circuit 400 in that circuit 900 includes a shutdown circuit 910. Circuit 910, in turn, includes first and second dividing resistors RD1 and RD2. Resistor RD1 has a first end connected to the output of buffer 320, and a second end; while resistor RD2 has a first end connected to the second end of resistor RD1, and a second end connected to ground.

In addition, circuit 910 also includes an operational amplifier (op amp) 920 that has a positive input connected to the first end of resistor RD2, a negative input connected to the base of transistor Q6, and an output.

In operation, a resistively divided fraction of the reference voltage $V_{REF}$ is applied to the non-inverting (positive) input of op amp 920, while the base voltage of transistor Q6 is applied to the inverting (negative) input of op amp 920. As the temperature changes, the base voltage of transistor Q6 changes.

The changing base voltage changes the difference between the voltages on the inverting and non-inverting inputs of op amp 920 which, in turn, places a voltage on the output in response to the change. The power dissipating functions of the device response to the output voltage and shut down the operation of the circuit when the output voltage reaches a predefined level.

If circuit 900 is untrimmed (via resistors R2 or R4), op amp 920 provides a significant reduction in the thermal voltage, and an even greater reduction when trimmed. (Remote sensing can also be accomplished by placing a diode-connected sense device, identical to transistor Q6 and similarly biased, close to the point to be monitored. A small additional error (±1° C.) is incurred mostly due to the area mismatch between the sense device and transistor Q6.)

Figure 10:
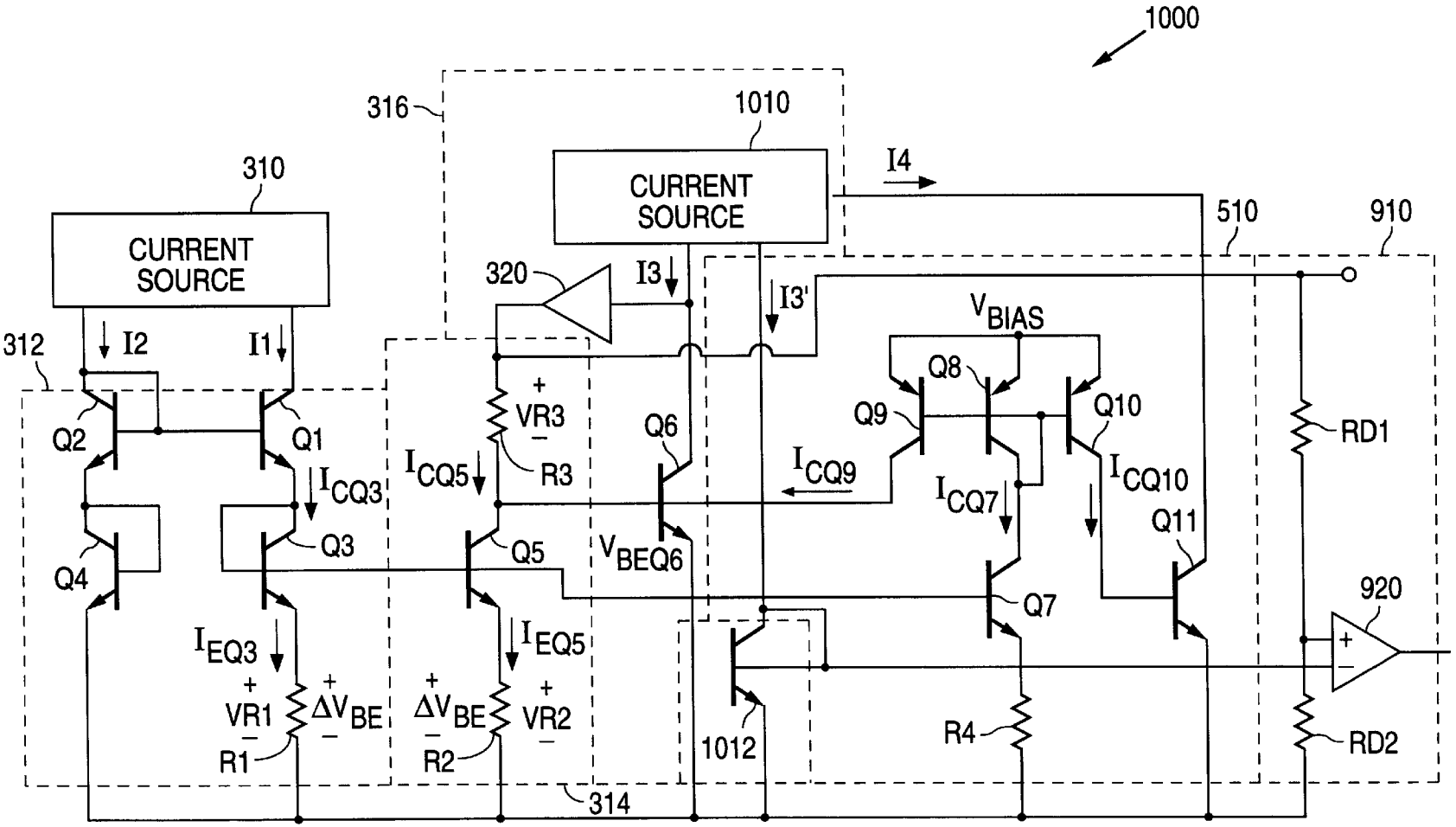
FIG. 10 is a schematic diagram illustrating a bandgap voltage reference circuit 1000 in accordance with the present invention.

FIG. 10 shows a schematic diagram that illustrates a bandgap voltage reference circuit 1000 in accordance with the present invention. Circuit 1000 is similar to circuit 900 and, as a result, utilizes the same reference numerals to designate the structures which are common to both circuits.

As shown in FIG. 10, circuit 1000 differs from circuit 900 in that circuit 1000 includes a current source 1010 that, in addition to currents I3 and I4, outputs a current I3' which is mirrored equivalent of current I3, and a sense transistor 1012 that has a collector connected to receive the current I3', a base connected to receive a voltage from the collector of transistor 1012, and an emitter connected to the second end of resistor R2. As further shown in FIG. 10, the negative input of op amp 920 is connected to the base of transistor 1012 rather than to the base of transistor Q6.

In operation, circuit 1000 operates the same as circuit 900 except that op amp senses the base-to-emitter voltage of transistor 1012 rather than the base-to-emitter voltage of transistor Q6. The advantage provided by transistor 1012 is that transistor 1012 may be located away from the bandgap circuit and closer to the power generating circuits which tend to overheat before the bandgap circuit.

Figure 11:
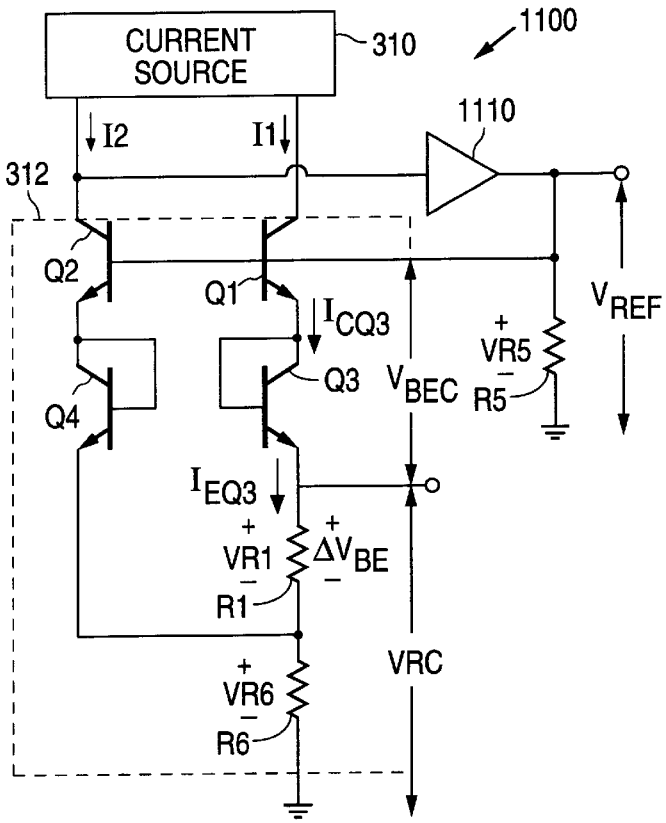
FIG. 11 is a schematic diagram illustrating a bandgap voltage reference circuit 1100 in accordance with the present invention.

FIG. 11 shows a schematic diagram that illustrates a bandgap voltage reference circuit 1100 in accordance with the present invention. Circuit 1100 is similar to circuit 300 and, as a result, utilizes the same reference numerals to designate the structures which are common to both circuits.

As shown in FIG. 11, circuit 1100 differs from circuit 300 in that circuit 1100 includes a unity-gain buffer 1110 which has a high input impedance, and resistors R5 and R6 in lieu of amplification circuit 314 and output circuit 316.

As further shown in FIG. 11, the collector of transistor Q2 is connected to the bases of transistors Q1 and Q2 through buffer 1110. In addition, resistor R5 is connected between the output of buffer 1110 and ground, while resistor R6 is connected between resistor R1 and ground, and to the emitter of transistor Q4.

In operation, circuit 1100 outputs a reference voltage $V_{REF}$ which is defined by the voltage VR5 across resistor R5. The voltage VR5, in turn, is defined by a voltage $V_{BEC}$ which represents the combined base-to-emitter voltage drops of transistors Q1 and Q3, and a voltage VRC which represents the combined voltage drops across resistors R1 and R6. The voltage $V_{BEC}$ has a negative temperature coefficient, while the voltage VRC has a positive temperature coefficient that is equal in magnitude to the negative temperature coefficient of the voltage $V_{BEC}$.

Since the voltages $V_{BEC}$ and VRC have equal but opposite temperature coefficients, changes in temperature cause the voltages $V_{BEC}$ and VRC to vary in equal and opposite directions, thereby leaving the voltage VR5 unchanged. As a result, the voltage VR5 is temperature compensated.

The voltage VRC is developed by utilizing bipolar transistors which are forced to operate with emitter currents that have unequal current densities. As noted above, transistors Q1/Q3 and Q2/Q4 are forced to operate with unequal emitter current densities when the second current I2 is L times greater than the first current I1, and the emitter area of transistors Q1 and Q3 are N times larger than the emitter areas of transistors Q2 and Q4, respectively.

As a result, the difference voltage $\Delta V_{BE}$, which has a positive temperature coefficient, is defined as the difference between the combined base-to-emitter voltages of transistors Q2 and Q4; and the combined base-to-emitter voltages of transistors Q1 and Q3, i.e., $\Delta V_{BE}=(V_{BEQ2}+V_{BEQ4})-(V_{BEQ1}+V_{BEQ3})$.

As shown in FIG. 11, the combined base-to-emitter voltages $V_{BEQ2}$ and $V_{BEQ4}$ of transistors Q2 and Q4 are equal to the combined base-to-emitter voltages $V_{BEQ1}$ and $V_{BEQ3}$ of transistors Q1 and Q3, and a voltage VR1 across resistor R1, i.e., $V_{BEQ2}+V_{BEQ4}=V_{BEQ1}+V_{BEQ3}+VR1$.

Since the difference voltage $\Delta V_{BE}$ is equal to the difference between the base-to-emitter voltages ($\Delta V_{BE}=(V_{BEQ2}+V_{BEQ4})-(V_{BEQ1}+V_{BEQ3})$), the difference voltage $\Delta V_{BE}$ is also equal to the voltage VR1 across resistor R1. In addition, since the difference voltage $\Delta V_{BE}$ has a positive temperature coefficient, the voltage VR1 across resistor R1 must also have a positive temperature coefficient. Thus, when the second current I2 is L times greater than the first current I1, approximately 232 mV are dropped across resistor R1 (for N=L=8) at 50° C.

Since the voltage VR1 is equal to the difference voltage $\Delta V_{BE}$ the emitter current $I_{EQ3}$ of transistor Q3, which flows through resistor R1, is also proportional to the voltage difference $\Delta V_{BE}$. In addition, the emitter current $I_{E4}$ of transistor Q4 is additionally proportional to $\Delta V_{BE}$ since the second current I2 is L times greater than the first current I1.

As a result, the combined emitter currents $I_{EQ3}$ and $I_{EQ4}$ flowing through resistor R6 are proportional to the difference voltage $\Delta V_{BE}$. Thus, the voltage VR6 across resistor R6 is proportional to the difference voltage $\Delta V_{BE}$ and, therefore, has a positive temperature coefficient.

The voltage $V_{BEC}$, which represents the combined base-to-emitter voltage drops of transistors Q1 and Q3, is approximately equal to 1250 mV at 50° C. Since 232 mV are dropped across resistor R1, approximately 1,018 mV need to be dropped across resistor R6. As a result, the difference voltage $\Delta V_{BE}$ (VR1) across resistor R1 need only be amplified by a gain factor of 5.4.

Figure 12:
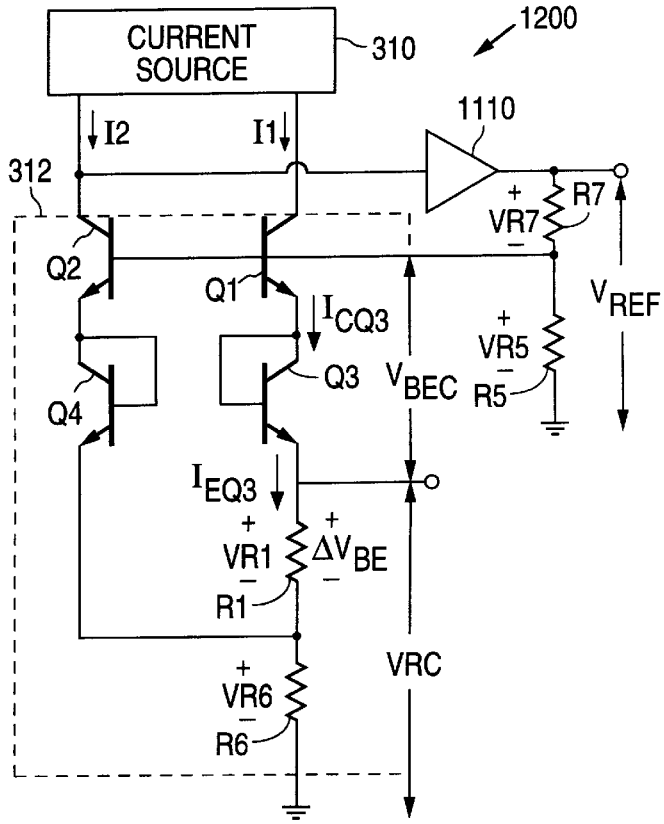
FIG. 12 is a schematic diagram illustrating a bandgap voltage reference circuit 1200 in accordance with the present invention.

FIG. 12 shows a schematic diagram that illustrates a bandgap voltage reference circuit 1200 in accordance with the present invention. Circuit 1200 is similar to circuit 1100 and, as a result, utilizes the same reference numerals to designate the structures which are common to both circuits.

As shown in FIG. 12, circuit 1200 differs from circuit 1100 in that circuit 1200 includes a resistor R7 between the output of buffer 1110 and resistor R5. Resistor R7 allows the magnitude of the reference voltage $V_{REF}$ to be amplified.

The voltage VR5 across resistor R5 (along with the resistance of resistor R5) defines the current through resistor R5 which, in turn, defines the voltage VR7 across resistor R7. Thus, since the voltage VR5 is temperature compensated, the voltage VR7 is also temperature compensated, thereby leaving the reference voltage $V_{REF}$ temperature compensated.

Figure 13:
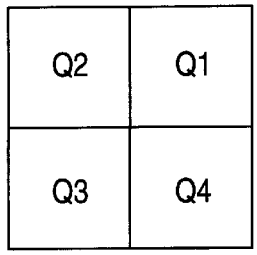
FIG. 13 is a block diagram illustrating the cross-quading of transistors Q1–Q4 in accordance with the present invention.

In further accordance with the present invention, by cross-quading transistors Q1–Q4 of circuits 1100 and 1200, the variability of the difference voltage $\Delta V_{BE}$ can be reduced by $\sqrt{2}$ (the square root of two). FIG. 13 shows a block diagram that illustrates the cross-quading of transistors Q1–Q4 in accordance with the present invention.

It should be understood that various alternatives to the embodiment of the invention described herein may be employed in practicing the invention. Thus, it is intended that the following claims define the scope of the invention and that methods and structures within the scope of these claims and their equivalents be covered thereby.

What is claimed is:

1. A voltage reference circuit comprising:

a first current source that outputs a first current and a second current; and a difference circuit connected to the first current source, the difference circuit having:

a first transistor having a collector connected to receive the first current, a base, and an emitter that outputs a first emitter current;

a second transistor having a collector connected to receive the second current, a base connected to the base of the first transistor, and an emitter, the base of the first transistor and the base of the second transistor being electrically coupled to the collector of the second transistor;

a third transistor having a collector connected to the emitter of the first transistor, a base coupled to the collector of the third transistor, and an emitter;

a fourth transistor having a collector connected to the emitter of the second transistor, a base coupled to the collector of the fourth transistor, and an emitter; and a first resistor having a first end connected to the emitter of the third transistor, and a second end connected to the emitter of the fourth transistor, the first resistor having a first difference voltage across the first and second ends, the first difference voltage having a positive temperature coefficient.

2. The circuit of claim 1 wherein the base of the first transistor and the base of the second transistor are connected to the collector of the second transistor.

3. The circuit of claim 2 wherein the first transistor has an emitter area that is N times larger than the emitter area of the second transistor.

4. The circuit of claim 3 wherein the third transistor has an emitter area that is N times larger than the emitter area of the fourth transistor.

5. The circuit of claim 4 wherein the second current is L times larger than the first current.

6. The circuit of claim 4 wherein the first and second currents are equal.

7. The circuit of claim 2 and further comprising an amplification circuit connected to the difference circuit, the amplification circuit forming a second difference voltage that is proportional to the first difference voltage, and amplifying the second difference voltage to form an amplified difference voltage, the amplified difference voltage having a positive temperature coefficient.

8. The circuit of claim 7 wherein the amplification circuit includes:

a fifth transistor that has a collector, a base connected to the base of third transistor, and an emitter;

a second resistor having a first end connected to the emitter of the fifth transistor, a second end connected to the second end of the first resistor, and a resistance equal to the resistance of the first resistor, the second resistor having the difference voltage across the first and second ends of the second resistor; and a third resistor having a first end connected to the collector of the fifth transistor, and a second end, the third resistor having the amplified difference voltage across the first and second ends of the third resistor.

9. The circuit of claim 8 wherein the second resistor is variable.

10. The circuit of claim 8 wherein the third transistor and the fifth transistor have equal emitter areas.

11. The circuit of claim 8 and further comprising an output circuit having a sixth transistor connected to the amplification circuit, the sixth transistor having a base-to-emitter voltage, the output circuit summing the amplified difference voltage and the base-to-emitter voltage to output a reference voltage, the base-to-emitter voltage having a negative temperature coefficient.

12. The circuit of claim 11 wherein the output circuit includes a second current source that outputs a third current;

wherein the sixth transistor has a collector connected to receive the third current, a base connected to the collector of the fifth transistor, and an emitter connected to the second end of the second resistor; and wherein the output circuit includes a buffer having an input connected to the collector of the sixth transistor, and an output connected to the second end of the third resistor.

13. The circuit of claim 11 wherein the output circuit includes a second current source that outputs a third current and a fourth current;

wherein the sixth transistor has a collector connected to receive the third current, a base connected to the collector of the fifth transistor, and an emitter connected to the second end of the second resistor, the sixth transistor having the base-to-emitter voltage; and wherein the output circuit includes a buffer having an input connected to the collector of the sixth transistor, and an output connected to the second end of the third resistor.

14. The circuit of claim 13 and further comprising a first compensation circuit connected to the output circuit that provides a base current and a collector current to the sixth transistor where the substrate current of the sixth transistor is defined to be inversely proportional to the beta of the sixth transistor.

15. The circuit of claim 14 wherein the first compensation circuit includes:

a seventh transistor that has a collector, a base connected to the base of the third and fifth transistors, and an emitter, the seventh transistor and the fourth transistor having equal emitter areas;

a fourth resistor that has a first end connected to the emitter of the seventh transistor, a second end connected to the second end of the second resistor, and a resistance that is N times larger than the resistance of the second resistor;

an eighth transistor that has a collector and a base connected to the collector of the seventh transistor, and an emitter connected to a bias voltage;

a ninth transistor that has a collector connected to the base of the sixth transistor, a base connected to the base of the eighth transistor, and an emitter connected to the bias voltage;

a tenth transistor that has a collector, a base connected to the base of the eighth transistor, and an emitter connected to the bias voltage, the ninth and tenth transistors having a collector area that is 1/Mth the area of the collector area of the eighth transistor; and an eleventh transistor that has a collector connected to the second current source to receive the fourth current, a base connected to the collector of the tenth transistor, and an emitter connected to the second end of the second resistor, the eleventh transistor being matched to the sixth transistor.

16. The circuit of claim 14 and further comprising a second compensation circuit connected to the first compensation circuit and the output circuit, the second compensation providing a base current and a collector current to the sixth transistor where the substrate current of the sixth transistor is defined to be equal to $-\frac{2}{3}$ power of the beta of the sixth transistor.

17. The circuit of claim 11 and further comprising a thermal shut-down circuit connected to the output circuit, the thermal shut-down circuit including:

a resistive divider that establishes a voltage at a node that is a fraction of the reference voltage; and a shut-down transistor having a collector, a base connected to the node, and an emitter.

18. The circuit of claim 11 and further comprising a thermal shut-down circuit connected to the output circuit, the thermal shut-down circuit including:

a resistive divider that establishes a voltage at a node that is a fraction of the reference voltage; and an operational amplifier having a positive input connected to the node, and a negative input connected to the base of the sixth transistor.

19. The circuit of claim 12 wherein the current source outputs a compensation current equal to the third current, and further comprising a thermal shut-down circuit connected to the output circuit, the thermal shut-down circuit including:

a resistive divider that establishes a voltage at a node that is a fraction of the reference voltage;

an operational amplifier having a positive input connected to the node, and a negative input; and a shut-down transistor having a collector connected to receive the compensation current, a base connected to the negative input of the operational amplifier and to receive a voltage on the collector of the shut-down transistor, and an emitter.

20. The circuit of claim 1 and further including:

a buffer having an input connected to the collector of the second transistor, and an output connected to the base of the first transistor and the base of the second transistor, wherein the bases of first and second transistors are electrically coupled to the collector of the second transistor via the buffer;

a second resistor having a first end connected to the second end of the first resistor and the emitter of the fourth transistor, and a second end; and a third resistor having a first end connected to the base of the first transistor, and a second end.

21. The circuit of claim 20 and further including a fourth resistor having a first end connected to the output of the buffer, and a second end connected to the first end of the third resistor.

* * * * *